US008287397B2

(12) United States Patent
Hill

(10) Patent No.: US 8,287,397 B2
(45) Date of Patent: Oct. 16, 2012

(54) INSTRUCTIONAL GOLF DEVICE AND METHOD FOR USING SAID DEVICE

(76) Inventor: Robert A. Hill, Webster, NY (US)

( * ) Notice: Subject to any disclaimer, the term of this patent is extended or adjusted under 35 U.S.C. 154(b) by 0 days.

(21) Appl. No.: 12/930,915

(22) Filed: Jan. 19, 2011

(65) Prior Publication Data

US 2011/0237340 A1 Sep. 29, 2011

Related U.S. Application Data

(60) Provisional application No. 61/336,225, filed on Jan. 19, 2010.

(51) Int. Cl.
*A63B 69/36* (2006.01)

(52) U.S. Cl. ..... 473/270; 473/273

(58) Field of Classification Search ..... 473/150, 473/157, 170, 172, 173, 174, 219, 257, 261, 473/262, 266, 268, 278, 270, 273; D21/791
See application file for complete search history.

(56) References Cited

U.S. PATENT DOCUMENTS

| | | | | | |
|---|---|---|---|---|---|
| 4,154,274 | A * | 5/1979 | Adamson | 206/315.2 |
| 4,434,983 | A * | 3/1984 | Taggart | 473/273 |
| 5,042,814 | A * | 8/1991 | Bennett | 473/225 |
| D354,107 | S * | 1/1995 | Kueng et al. | D21/791 |
| 5,799,967 | A * | 9/1998 | Lin | 280/646 |
| 6,209,721 | B1 * | 4/2001 | Sharpe et al. | 206/315.6 |
| 6,579,191 | B1 * | 6/2003 | Hambly | 473/151 |
| 6,659,477 | B2 * | 12/2003 | Jung | 280/47.26 |
| 7,549,534 | B1 * | 6/2009 | Parpart | 206/315.7 |
| D604,509 | S * | 11/2009 | Andrews | D3/259 |
| 7,832,557 | B2 * | 11/2010 | Amin | 206/315.5 |
| 2009/0176594 | A1 * | 7/2009 | Loh et al. | 473/221 |

* cited by examiner

*Primary Examiner* — Nini Legesse
(74) *Attorney, Agent, or Firm* — Bassett IP Strategies; David F. Bassett

(57) ABSTRACT

The present invention is an instructional golf device allowing a golfer to bring a golf club back correctly. The device is portable, can be used on level or rough terrain and on a variety of surfaces including grass, artificial ground, or even concrete or pavement. The golfer can hear the device make a sound when the golf club follows the correct path during the back swing.

2 Claims, 6 Drawing Sheets

INSTRUCTIONAL GOLF DEVICE AND METHOD FOR USING SAID DEVICE

CROSS-REFERENCE TO RELATED PATENT APPLICATIONS

Priority for this patent application is based upon provisional patent application 61/336,225 (filed on Jan. 19, 2010). The disclosure of this United States patent application is hereby incorporated by reference into this specification.

BACKGROUND OF THE INVENTION

The game of golf has been around in one form or another since before St. Andrew's was founded in 1754. The idea of providing a device to correct a golfer's stance, position, swing, and accuracy has been around nearly as long. The present invention provides such a device to correct these problems.

Many golfers, both novice and advanced, have difficulty bringing a golf club to the correct position during the backswing of the golf club. Using an improper backswing may cause an errant shot when hitting the ball. Golfers should bring the club head back so that a straight line would be formed leading from the club head straight away from the ball and on to the target. The present invention helps the golfer do this if he contacts a spring located at the back of the device each time he swings. It also helps the golfer on the downswing as well.

SUMMARY OF INVENTION

The present invention is an instructional golf device allowing a golfer to bring a golf club back correctly. The device is portable, can be used on level or rough terrain and on a variety of surfaces including grass, artificial ground, or even concrete or pavement. The golfer can hear the device make a sound when the golf club follows the correct path during the back swing.

BRIEF DESCRIPTION OF FIGURES

Embodiments of the present invention will be described by reference to the following drawings, in which like numerals refer to like elements, and in which.

DESCRIPTION OF INVENTION

Figure 1:
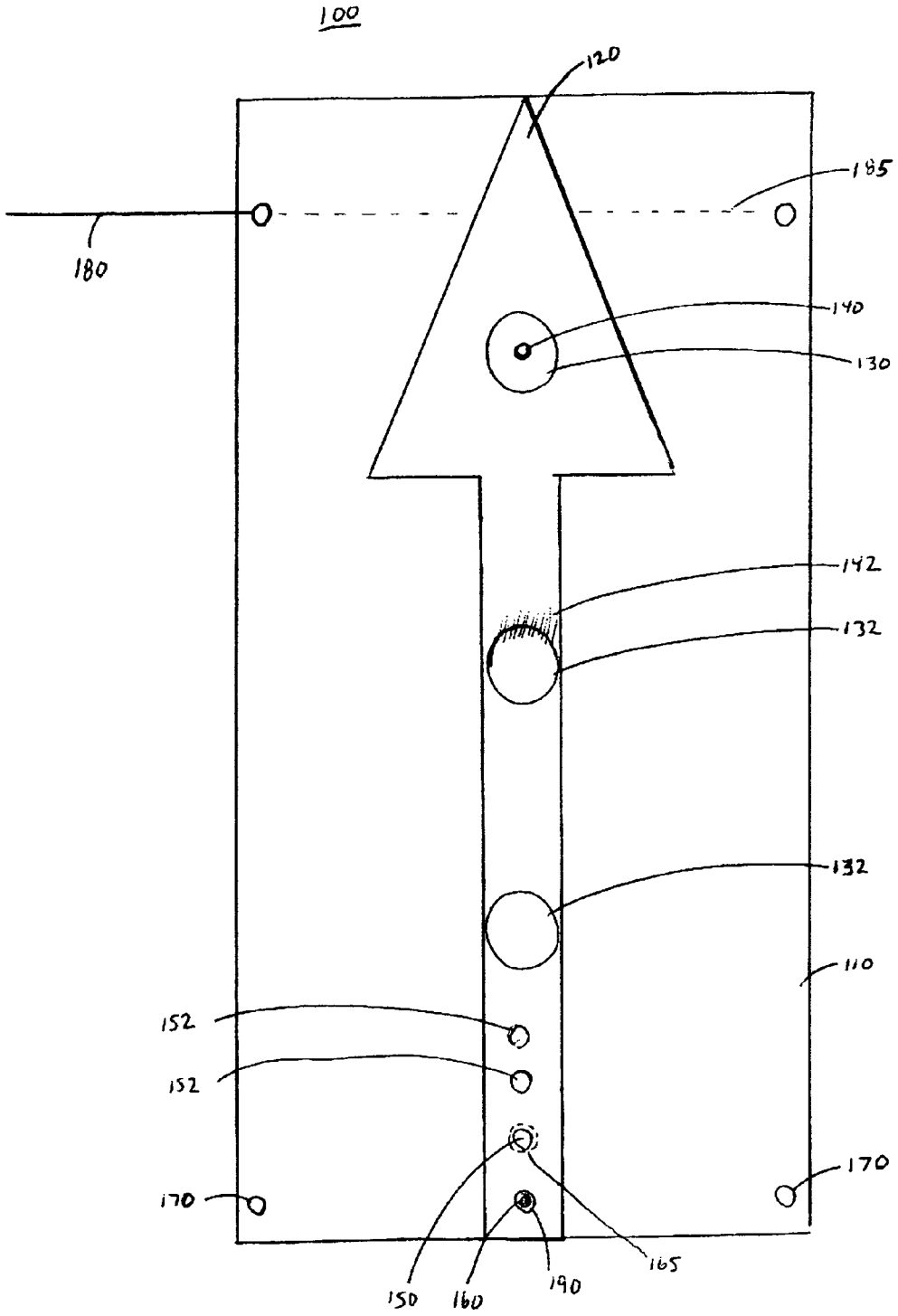
FIG. 1 is a schematic view of one preferred embodiment of an instructional golf device.

In FIG. 1, one preferred embodiment of an instructional golf device 100 is depicted. The golf device 100 comprises a mat 110 which is placed on the ground in front of a golfer swinging a golf club, said mat 110 may be anchored on the ground. The mat 110 has a preferably rectangular shape. The length of the mat 110 is at least about 24 inches and the width of the mat 110 is at least about 4 inches. The length of the mat 110 is more preferably at least about 24 inches and at most about 36 inches. The length of the mat is even more preferably at least about 28 inches and at most about 32 inches.

Figure 2:
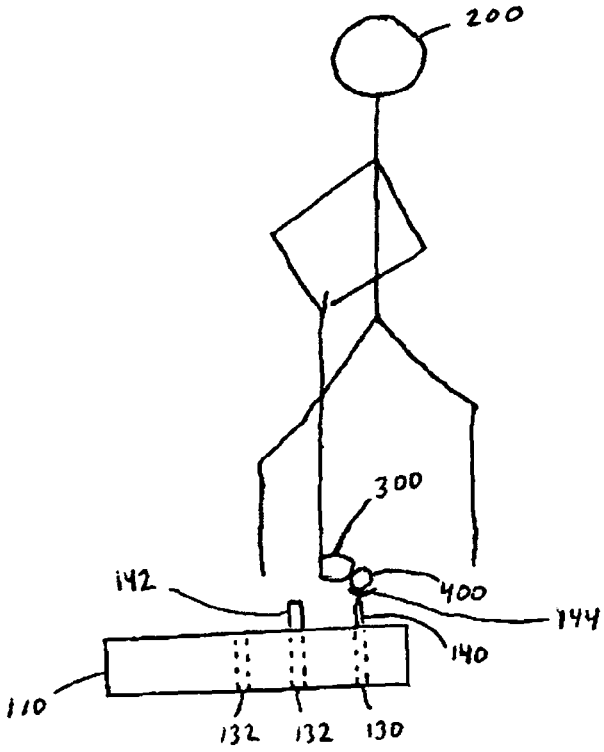
FIG. 2 is an overhead view of a golfer using the instructional golf device to aim a golf ball towards a target.

The width of the mat 110 is preferably at least about 4 inches and at most about 8 inches. The width of the mat is more preferably at least about 4 inches and at most about 6 inches. The upper surface of the mat 110 has a directional marker 120 which assists the golfer in focusing his golf swing. The directional marker 120 is aligned parallel to the length of the mat and is situated in the middle of the mat 110. The directional marker preferably runs the length of the mat 110. The front of the directional marker 120 is located at the front of the mat 110 and the rear of the directional marker 120 is located at the rear of the mat 110. In the preferred embodiment depicted in FIG. 1, the shape of the directional marker 120 is that of an arrow. In the front of the arrow is a first alignment aperture 130. The first alignment aperture 130 passes through the entire thickness of the mat 110 creating a hole through the mat 110. The first alignment aperture 130 is located at about 1 to 2 inches from the lead edge of the mat. Referring to FIG. 2, into this first alignment aperture 130 a means for teeing up a golf ball 140 may be placed. The means for teeing up a golf ball 140 may be any readily available means for teeing up a golf ball.

Examples of such include the Groove RT manufactured by Precision Tees, Inc. of Playa Del Ray, Calif. and 1¾ inch rubber tee manufactured by Hornungs Golf Products of Fond du Lac, Wis. The diameter of the first alignment aperture 130 is sized to be large enough to snuggly hold a tee. When a rubber tee is the means for teeing up a golf ball 140, the first alignment aperture 130 preferably has a diameter of about 0.625 inches. The means for teeing up a golf ball 140 is preferably sized such that when the golf ball is teed up, the golf ball should be at an elevation where the center of the club face will make contact with the golf ball.

The mat 110 possesses at least 1 additional alignment apertures 132. It is preferable for the mat to possess at least 2 additional alignment apertures and at most 4 additional alignment apertures. These additional alignment apertures are spaced approximately 3 inches apart along the lengthwise axis of the mat 110. As depicted in FIG. 2, the additional alignment apertures are provided to allow for a brush tee 142 to be inserted into the mat 110. The brush tee 142 may be any readily available brush tee, such as the Brush-T manufactured by Bonfit America Inc. of Culver City, Calif. The brush tee 142 is used to prop a golf ball up above the mat surface, and the golfer 200 may tee his golf ball 400 on the brush tee 142. The brush tee 142 is preferably trimmed to about 0.5 inches to 1 inch tall to allow for the golf ball 400 to be minimally placed above the mat 110. The appropriate height for the brush tee 142 is such that the golf ball 400 should be at an elevation where the center of the club face 300 will make contact with the golf ball. The diameter for each additional alignment aperture 132 is sized to be large enough to snuggly hold the brush tee 142. When a Brush-T is the brush tee 142, the additional alignment apertures 132 preferably each have a diameter of about 0.625 inches. The additional alignment apertures 132 may pass through the entire thickness of mat 110 or they may only form a depression in the upper surface of the mat 110. Referring to FIG. 2 and the embodiment depicted therein, the brush tee 142 is inserted into the mat 110 such that the bristles of the brush tee protrude above the upper surface of the mat 110 and the golf ball 400 teed on the brush tee 142 is preferably between about ¼ inch and ¾ inch above the mat 110. When the additional alignment apertures 132 are sized properly, the brush tee 142 will fit snugly in the instructional golf device 100.

Referring again to FIG. 2, please note that although the means for teeing up a golf ball 140 and brush tee 142 are both depicted, a golfer will only use one at a given time. The golfer will not use both at the same time. Also, please note that the brush tee 142 may be placed in any additional alignment aperture 132. The appropriate additional alignment aperture 132 will be determined by the choice of golf club 300 used and will be discussed later in this specification.

Figure 3:
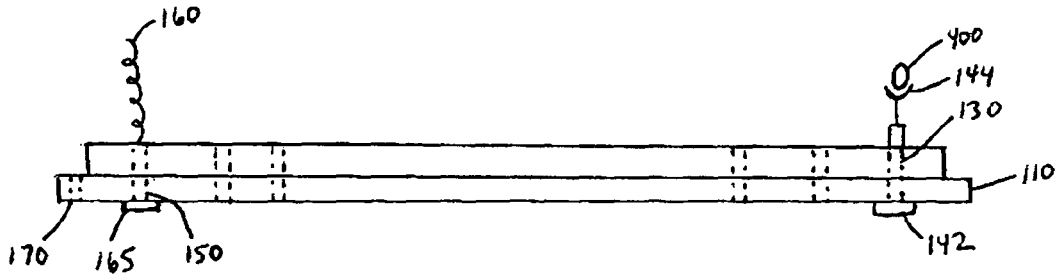
FIG. 3 is a profile view of the instructional golf device.

Referring to FIG. 3, to increase the height of the teed golf ball 400 above the upper surface of the instructional golf device 100, a tee 144 may be placed in the rubber tee 140. An extensible tee may also be inserted into the additional alignment aperture 132 to tee the golf ball 400.

The mat 110 may be anchored to the ground using any readily available means for anchoring a device. In the preferred embodiment depicted in FIGS. 1 and 3, the means to anchor the device to the ground include 2 grommeted apertures each identified as 170 which are located towards the rear corners of the mat. Each grommeted aperture 170 is preferably located at least about 0.5 inches from the rear corner of the mat 110 and at most about 1 inch from the rear corner of the mat 110. Each grommeted aperture 170 is more preferably located about 0.625 inches from the rear corner of the mat 110. Each grommeted aperture 170 will allow for a nail, golf tee, or similar object to pass through the mat 110 and allow the mat 110 to be fixed in place on the ground. In another preferred embodiment, not depicted, a single grommetted aperture is located near the midpoint of the rear of the mat. The single grommetted aperture is preferably located at least about 0.5 inches from the rear of the mat and at most about 2 inches from the rear corner of the mat. The single grommeted aperture is more preferably located at about 1 inch from the rear of the mat.

At the rear of the mat 110 is a small aperture 150. The small aperture 150 is located along the midpoint of the width of the mat 110. The small aperture is sized such that a small spring 160 will fit snuggly in the small aperture 150. The small spring 160 is attached to the mat 110 via the small aperture 150. This small spring protrudes perpendicularly through the upper surface of the mat 110. The small spring 160 preferably protrudes 1 to 3 inches above the upper surface of the mat 110. As shown in FIG. 3, the small spring stands straight up when the instructional golf device 100 is placed flat on the ground. This small spring 160 is a critical component of the instructional golf device 100. The small spring 160 provides the golfer 200 an audible signal that the backswing is following the correct vector.

It is preferable for the mat to possess at least 2 additional small apertures and at most 4 additional alignment apertures. Each additional small aperture is referenced in FIGS. 1 and 3 as additional small aperture 152. These additional small apertures 152 are spaced approximately 3 inches apart along the lengthwise axis of the mat 110. The additional small apertures each identified as 152 allow for the location of the small spring 160 to be adjusted.

In one preferred embodiment of the present invention, the small spring 160 is placed in a disc shaped object 165 prior to being placed in the mat 110. The disc shaped object 165 is preferably an easily machined object with little or no flexibility. A representative example of such an object is a metal flat washer. The small spring 160 is attached to the center of the disc shaped object 165 by readily available means. Such means may include welding. This is the preferred method of mounting the spring because it allows for easier adjustability of the instructional golf device 100 for golfers of different sizes. This method of mounting the spring also allows for easily removing the small spring 160 from the instructional golf device 100, which keeps the small spring 160 damage-free when transporting the instructional golf device 100.

Figure 4:
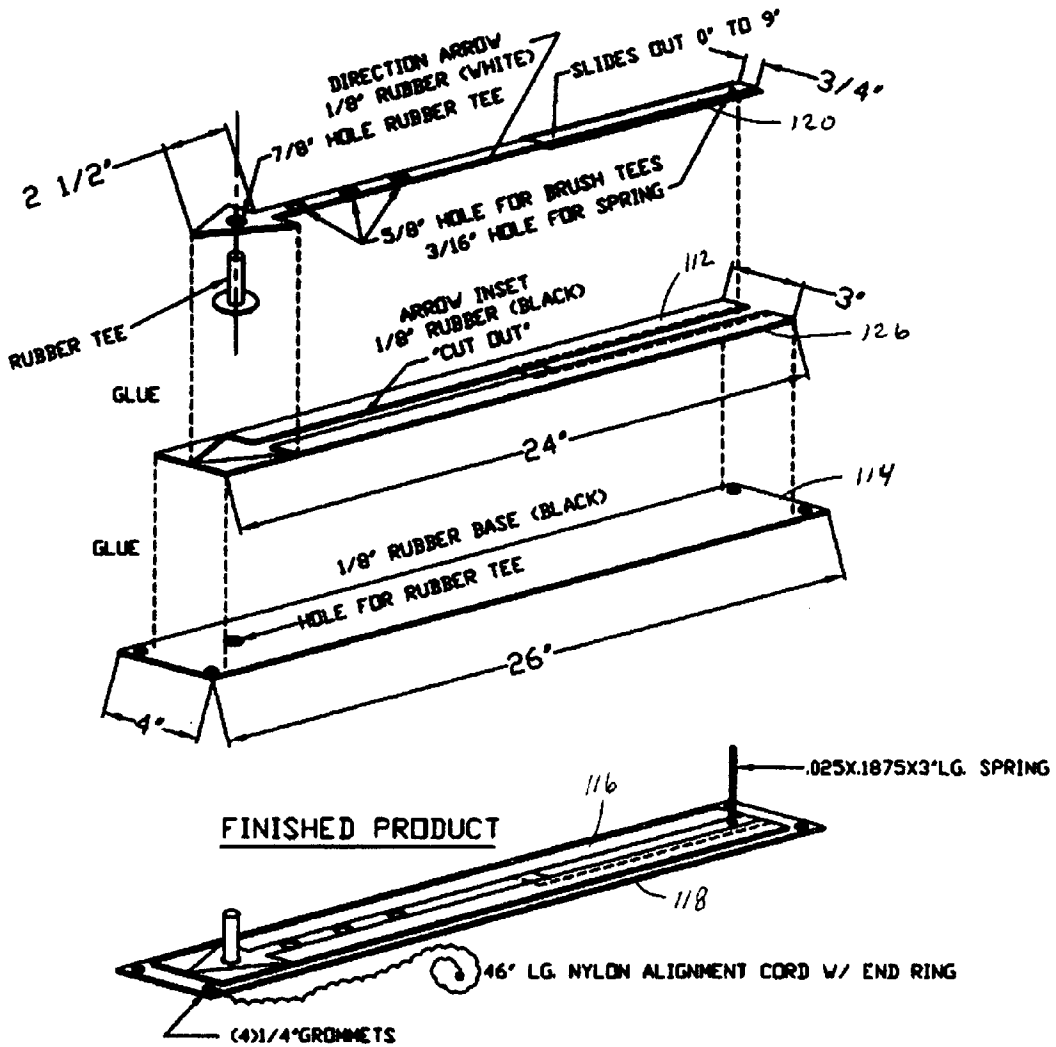
FIG. 4 is an exploded view of the instructional golf device.

FIG. 4 is an exploded view of the instructional golf device 100. In the preferred embodiment depicted in FIG. 4, the mat 110 is comprised of 2 layers situated with one layer on top of the other. Each layer is preferably made from a durable elastic material. Acceptable materials for construction include synthetic rubber material or polymers such as polyethylene, polypropylene, polyethylene copolymers, and the like. The two layers are bound together using readily available means for binding. Such means for binding may include but are not limited to heat welding, gluing, and mechanical fasteners such as rivets, nuts and bolts, and staples. The preferred method for binding the two layers together is gluing.

In the preferred method for construction of the mat 110, the top layer 112, which is constructed of a durable elastic material, is smaller than the lower layer 114 and is placed such that the center of the top layer 112 is directly over the lower layer 114, and the lower layer 114 projects in all directions about 0.5 inches beyond the edge of the top layer 112. This top layer 112 is cut such that the outline of the directional marker 126 is incised into the top layer 112. Into this outline of the directional marker 126 is inset another durable elastic material in the shape of the directional marker 120. In the preferred embodiment depicted in FIG. 4, this directional marker 120 is an arrow. The two portions of the top layer 112 are constructed of materials with contrasting colors so that the directional marker is readily visible. This method of using two contrasting materials is preferable to simply placing a directional marker 120 on the mat 110 using a method such as painting, printing, or silk-screening. A method that places the directional marker 120 on the surface of the mat 110 will not be durable and the directional marker 120 may wear off the device with use. Although a method of applying a directional marker such as painting, printing, or silk-screening is less desirable due to durability considerations than construction the mat 110 of materials with contrasting colors, the teachings of the device are not avoided by using one of these inferior methods. The lower layer 114 may optionally have labels 116, 118 placed on it. The labels 116, 118 may be placed by any readily available means such as etching, gluing, riveting. Each label (label 116 or label 118) may be etched, a metal plate, a plastic sleeve that protects a paper label. The labels 116, 118 may be used for purposes such as advertising, providing an owner's name and contact information, providing tips for using the instructional golf device, and the like.

Figure 5:
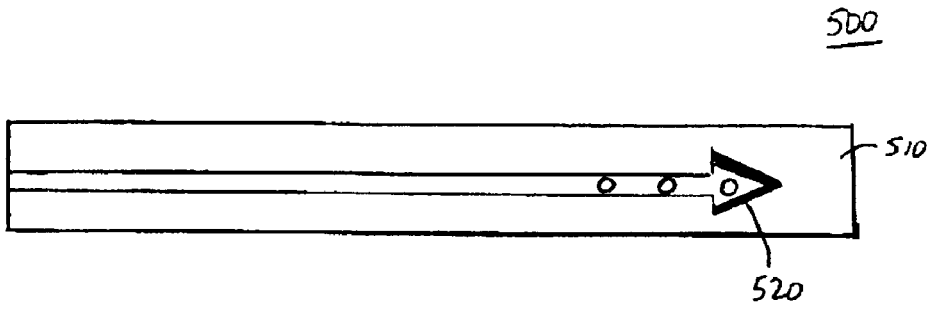
FIG. 5 is a schematic view of another preferred embodiment of an instructional golf device.

In another preferred embodiment, a mat 510 is made of a single layer of artificial turf. This is shown in FIG. 5. The mat 510 is preferentially made such that a directional marker 520 is made of artificial turf fibers of at least one contrasting color to the primary color of the artificial turf. The directional marker 520 may also be painted or screen printed onto the artificial turf. It is preferred for the directional marker 520 to take the shape of an arrow. When the instructional golf device is in use, the arrow will point toward a target a golfer is aiming at.

Figure 6:
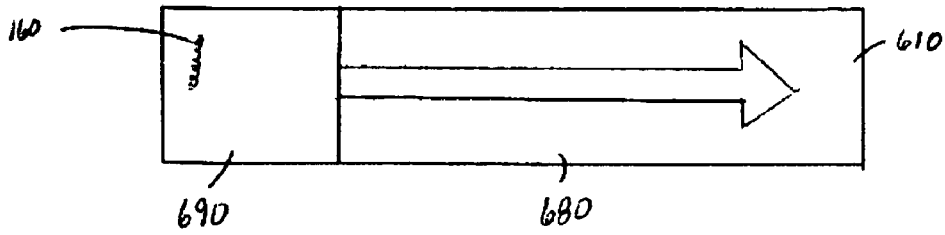
FIG. 6 is a schematic view of another preferred embodiment of an instructional golf device.

FIG. 6 represents another preferred embodiment of an instructional golf device 600. In FIG. 6 the instructional golf device 600 comprises a mat 610. The mat 610 is manufactured in two distinct parts with the separable back portion holding the spring. Separating the mat into two distinct parts allows for easier carrying and packaging of the instructional golf device. This also allows for adjusting the distance between the front of the directional marker and the spring 160 which allows for larger golfers to successfully use the instructional golf device 600. The back portion of the mat 610 is separable from the front portion of the mat 610. This separable back portion of the mat can be slid out to accommodate larger golfers. A small spring is attached to the separable back portion of the mat to allow the linear distance between a tee and the spring to be adjustable.

The two distinct parts can be held together by any readily available means of joining two objects together. The readily available means of joining two objects may include Velcro tabs, a hinge, or the like. It is preferable to use alignment marks on the two objects to keep them properly aligned when they are separated. An example of such alignment marks include two thin rails which have perpendicular marks along their lengths which may correspond to marks on the interior edge of each of the two distinct parts.

Referring again to FIG. 1 and the instructional golf device 100 depicted therein, the mat 110 may possess an extendible member 170. Attached to the mat 110 is an extensible member 180. The extensible member 180 is attached to mat 110 along the edge nearer the golfer 200 at a point that is 1 inch forward to the first alignment aperture 130. The extensible member 180 may be comprised a rigid member or a flexible member. The extensible member 180 is attached to the mat 110 using any readily available means for attachment. A representative example flexible extensible member 180 would be a chord. The acceptable means for attachment may include, but are not limited to: a rivet; a threaded bolt and wing nut; and the like. The preferred means for attachment is via a threaded bolt and a wing nut which allows for ease of attachment and solid attachment. For a right handed golfer, this point of attachment will be along the nearer left side of the mat 110 and for a left handed golfer, this point of attachment will be along the nearer right side of the mat 110.

Figure 7:
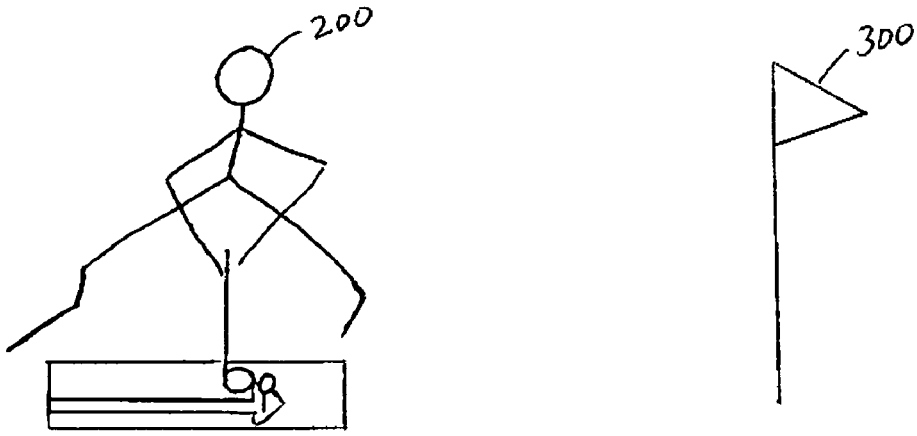
FIG. 7 is an overhead view of a golfer using the instructional golf device.

The golfer will extend the extensible member 180 by extending it perpendicularly to the mat 110. The golfer will stand facing the mat 110 with his lead foot (left foot for a right handed golfer, and right foot for a left handed golfer) located approximately 1 inch outside the extensible member. This is depicted in FIG. 7.

In another preferred embodiment, not depicted, the extensible member is attached to the instructional golf device at the first alignment aperture. A golfer using the instructional golf device configured in this manner would stand facing the mat with his lead foot located approximately two inches outside the extensible member.

Referring again to FIG. 1, in the preferred embodiment in which the extensible member 180 is flexible, the flexible extensible member is preferentially attached to the mat with a grommet. The grommet is located approximately 1 inch ahead of the first alignment aperture. A line 185 perpendicular to the direction of swing of the golf club is marked on the mat. In the preferred embodiment depicted in FIG. 1, the line 185 is embossed on the mat. This line 185 is used as a guide to allow the golfer to ensure that the flexible extensible member 180 is being pulled from the device in a nearly perpendicular direction to the direction of the swing of the golf club.

The golfer 200 should position the instructional golf device 100 such that the directional marker 120 points at the intended target 300. FIG. 2 provides a representation of a golfer 200 using the instructional golf device 100. The golfer 200 will stand in front of the mat with the inner edge of his lead foot touching the extensible member 180. The golfer will place his lead foot touching the extensible member 180 regardless of the choice of club. The distance between the golfer 200 and the instructional golf device 100 is determined by the size and height of the golfer 200 hitting a golf ball 400. The shorter the golfer 200 is, the shorter the distance between the instructional golf device 100 and the golfer 200 and the taller the golfer 200 is, the greater the distance between the instructional golf device 100 and the golfer 200. The distance between the golfer and the instructional golf device 100 will be based upon the choice of golf club used by the golfer 200. The distance is chosen such that when the golf club is addressing the golf ball, the golfer's back is straight and buttocks are out. When the chosen golf club is a driver, the golfer 200 will stand about 36 inches away from the teed ball placed on the instructional golf device 100. When the chosen golf club is a 5 iron, the golfer 200 will stand about 21 inches away from the teed ball placed on the instructional golf device 100. The golfer's feet are typically placed parallel to the instructional golf device 100.

The instructional golf device 100 may also possess extra pairs of grommeted apertures for carrying the device 100 from a golf bag. These grommeted apertures are preferably located along the sides near the end of the device. In the case where there is the extra grommet hole near the rear of the directional marker 120, this extra grommet hole can be used to keep the instructional golf devise 100 securely attached to the golf bag while the golfer 200 carries the golf bag with the attached instructional golf device 100.

Figure 8:
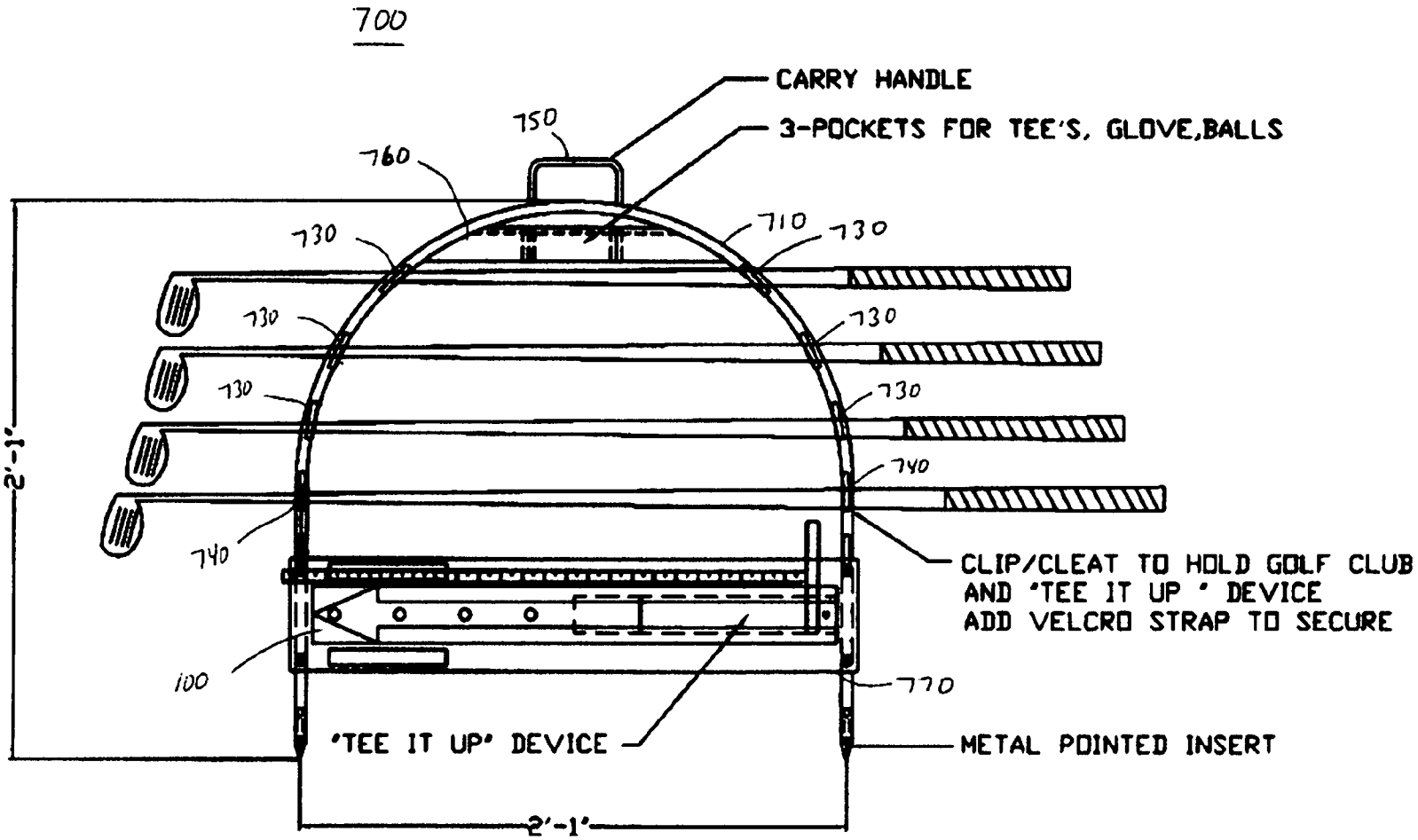
FIG. 8 is a view of the instructional golf device on a carrying caddy.

Referring to FIG. 8 and the preferred embodiment depicted therein, the golf instruction device 100 is shown in a carrying caddy 700. The carrying caddy 700 is designed to carry the golf instruction device 100, at least one golf club 800, and other accessories. The other accessories may include, but are not limited to, golf tees, golf gloves, golf balls, rubber tees, the extensible member, and springs.

In the preferred embodiment depicted in FIG. 8, the carrying caddy 700 for the instructional golf device 100 comprises a rigid tube 710 in a sweeping hemispherical curve. Each end of the rigid tube 710 extends beyond the curve by at least 4 inches in a straight path extending tangentially to the end of the hemisphere. The rigid tube 710 may be constructed of any lightweight, strong material such as aluminum; a plastic material such as polyvinylchloride or CPVC; or light gauge steel. At each end of the rigid tube 710 a base 720 to allow the carrying case to remain vertically oriented is attached. Each base 720 may consist of any readily available means for a support base, including but not limited to a perpendicular block with a post protruding out of the plane of the perpendicular block, a collapsible tripod (similar to a music stand), or a metal spike that slides into the rigid tube. The spikes may be inserted into the ground to allow the carrying caddy to remain vertical. The carrying caddy 700 will be about 25 inches wide. The height of the carrying caddy 700 will be about 25 inches at the top of the hemispherical curve.

Attached to the rigid tube 710 will be an even number of clips 730. The clips 730 are spaced along the perimeter of the rigid tube 710 in pairs. Each clip 730 is aligned with another clip 730, comprising a pair of clips 740; each clip in a clip pair will be elevated equivalently so that a straight line connecting the two clips will be parallel to the surface the carrying caddy is situated on. Clips can be on either side of the caddy (offset) from the clips located on the other side of the caddy.

The lowest pair of clips 740 is used to secure the instructional golf device 100 to the carrying caddy 700. Above this pair of clips 740 is at least one additional pair of clips 740 to allow for carrying a golf club 800. To each clip 730 can be attached a means to secure the carried component. The means to secure the carried component can include such items as Velcro straps or cloth laces or equivalent means.

At the midpoint of the hemispherical curve, a carrying handle 750 will be attached to the rigid tube 710. The carrying handle 750 can be made of any readily available material such as aluminum, plastic, leather, or reinforced cloth and can be attached to the carrying caddy 700 using readily available means.

As depicted in FIG. 8, at least one small pocket 760 is attached to the carrying caddy 700 along the mid-section of the carrying caddy 700. In the preferred embodiment depicted in FIG. 8, there are three small pockets 760. These small pockets 760 can be made of any readily available flexible, yet strong material, such as polyethylene, strong fabric such as denim, and the like. The small pockets 760 may have readily available means to keep the pockets closed. Such means may include drawstrings or a Velcro flap or the like. It should be noted that the configuration of the carrying caddy 700 depicted in FIG. 8 is for illustrative purposes and should not be considered limiting.

In one embodiment of the present invention, the mat 100 is flexible and may be folded in half to allow for easier transport.

Method for Using Instructional Golf Device

The instructional golf device 100 is used to ensure a proper hitting position. It is used to correct the hitting position each time a golfer hits a golf ball. A golfer should keep his backswing low for the first 6 to 8 inches of backswing.

The general method for using the instructional golf device is described herewith. A golfer will make specific adjustments to these general instructions when hitting a golf ball with a particular golf club, such as a driver, 3 wood, 5 iron, and the like. The specific adjustments will be described after the general method is described. A golfer may use the instructional golf device as a guide to hit a golf ball towards an intended target. The golfer places a small spring into the instructional golf device. The golfer also places a means for teeing up a golf ball into the instructional golf device. When the golfer is hitting a driver, the means for teeing up a golf ball will be a tee. When the golfer is hitting another club, the means for teeing up a golf ball may be a tee or a brush tee. With the means for teeing up a golf ball in place, the golfer places the instructional golf device on the ground in front of him. The instructional golf device should be aligned on the ground such that the directional marker is pointing to an intended target. The intended target is chosen as an object the golfer would like to have his golf shot aim towards. For example, when a golfer prepares to hit his first shot on a particular hole, he will typically use a driver. When using the driver, the directional marker should typically be pointed towards the middle of the fairway. When the golfer prepares to hit a shot to a green, the directional marker may be pointed towards a flag or other reference point such as the middle of the green.

After aligning the instructional golf device properly towards the target, the golfer may anchor the instructional golf device to the ground by placing 1 or 2 tees through the grommets for anchoring the device. This will keep the target anchored in place as the golfer swings the golf club and hits the golf ball.

The golfer will place a golf ball on a tee to elevate the golf ball. The golf ball may be a regulation golf ball or it may optionally be a short or medium distance golf ball designed to facilitate golf practice.

When the golfer is using a driver or wood, the golfer should align the extensible member perpendicular to the mat. The golfer will stand in front of the mat with the inner edge of his lead foot touching the extensible member. The golfer will place his lead foot touching the extensible member regardless of the choice of club. The distance between the golfer and the instructional device will be based upon the choice of golf club used by the golfer. The distance is chosen such that when the golf club is addressing the golf ball, the golfer's back is straight and buttocks are out. The feet may be placed open, nearly parallel or closed to the instructional golf device as appropriate to the club used.

The golfer should ensure the face of the golf club is perpendicular to the direction to the target.

Once the golfer is in the proper position and has addressed the golf ball, he should begin the back swing immediately. The golfer should bring the club head straight back. He will hear a slight ping noise as the club head strikes the spring. On the follow through the golfer should swing straight through on the downswing. The golfer will hear a slight ping noise as the club head again strikes the spring.

As the golfer follows straight through his swing, the golf ball will travel toward the intended target.

Hitting a Driver or Wood

For the using the instructional golf device with a driver, the golfer's feet should be 7 to 8 inches wider than his shoulders as measured from the big toe of each the left & right foot.

The golfer should place a tee in the first alignment aperture 140 in the instructional golf device and place a ball upon the tee. The ball should be placed 1 to 2 inches inside of the left heel from the extensible member. The golfer then places the inside of his lead foot (left foot for a right handed golfer, right foot for a left handed golfer) against the extensible member. This is depicted in FIG. 7.

Figure 9:
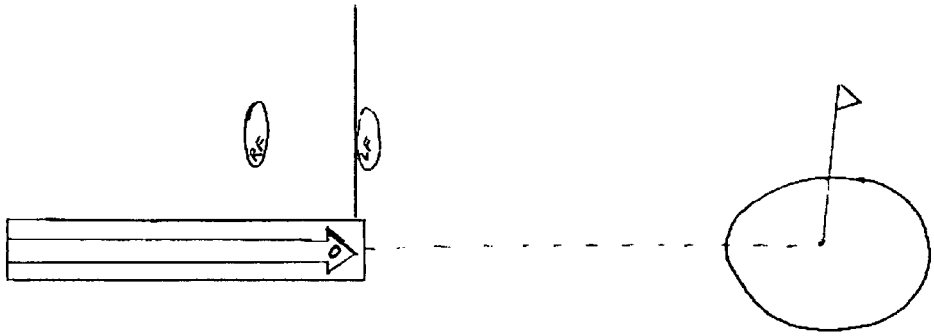
FIG. 9 is an overhead view of a golfer using the instructional golf device.

When using the driver, the feet are placed slightly closed to the direction to the target. The feet are initially placed about 36 inches away from the ball teed on the device, such that the trailing foot (right foot for a right handed golfer, left foot for a left handed golfer) is placed back 1 to 2 inches backwards from the left foot. This is depicted in FIG. 9.

When hitting a driver, the golfer's hands should be placed approximately 1 inch inside of the left knee cap.

Hitting a 2 or 3 Iron

When hitting with a 2 or 3 iron, the golfer should place the means for teeing up a golf ball into the secondmost aperture on the golf device.

When using the 2 or 3 iron, the feet are placed slightly closed to the direction to the target. The feet are initially placed about 34 inches away from the ball teed on the device, such that the trailing foot is placed back 1 to 2 inches backwards from the left foot.

This will result in placing the ball approximately 2 to 3 inches inside the left heel (for a right handed golfer) when the golfer hits with either the 2 or 3 iron.

Hitting a 4, 5, or 6 Iron

When hitting with a 4, 5, or 6 iron, the golfer should place the means for teeing up a golf ball in the thirdmost aperture on the golf device, which results in the golf ball being played approximately 4 to 6 inches inside the golfer's left heel (for a right handed golfer). When using the 4, 5, or 6 iron, the golfer's feet are approximately 5 inches closer together than when the golfer is using a driver.

The golfer's feet are parallel to the line of flight when hitting with a 4, 5, or 6 iron. The right foot is not behind the left foot, as would be the case for a right handed golfer hitting a golf ball with a driver.

Hitting a 7, 8, or 9 Iron or a Wedge

When hitting with a 7, 8, or 9 iron, or a wedge, the golfer should place the means for teeing up a golf ball in the fourthmost aperture on the golf device. This results in the ball being placed approximately in the middle of the golfer's stance (approximately 7 inches inside the left heel).

The position of the feet when hitting with a 7, 8, or 9 iron, or wedge is slightly open (meaning the right foot is ahead of the left foot, 1 or 2 inches, for a right handed golfer).

When hitting iron shots, the golfer may remove the rubber tee and use a shorter tee. This shorter tee will either be "the brush tee" or shorter length tee that fits into any of the larger circles.

The golf tee may be used for either left handed or right handed players.

The spring may be placed forwards approximately 1 to 3 inches when the golfer is hitting with the 4, 5, or 6 irons and may be placed forwards approximately 2 to 4 inches when using the 7, 8, or 9 irons, or wedge.

Each time the player swings he should lightly hit the spring with the golf club on the back swing. This is important since the goal is to hit the ball as straight as possible and the spring was designed for this purpose.

Figure 10:
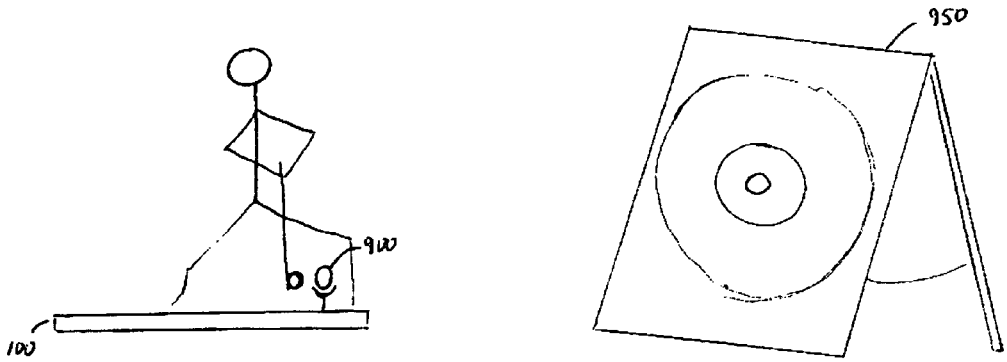
FIG. 10 is a view of a golfer using the instructional golf device to aim at a contest target.

The instructional golf device may be used with a target and short flight golf ball, such as Described in U.S. Pat. No. 4,577,867 (Short flight golf ball and game), the Short Flyte Practice Golf Ball manufactured by C-Associates of Sodus, N.Y., and the like, to create a contest for multiple users of the instructional golf device. A representative set up for such a contest is shown in FIG. 10. In FIG. 10, an instructional golf device 100, short flight golf ball 900, and a target 950 are depicted. The contest can be set up in a minimally sized space which allows for holding the contest at locations that are much smaller than a typical golf hole such as an outdoor carnival booth, a supermarket parking lot, or the like. The contest may be set up indoors when adequate ceiling space (at least approximately 15 feet height) is available, as would be found in a typical multistory shopping mall or gymnasium.

The target 950 will preferably be sized to be at least approximately 4 foot by 4 foot and at most approximately 8 foot by 8 foot.

The instructional golf device 100 is aligned to point to the target 950. A golfer tees up the short flight golf ball 900 and proceeds to hit the short flight golf ball 900 at the target 950.

Although several embodiments of the present invention and its advantages have been described in detail, it should be understood that various changes, substitutions and alterations can be made herein without departing from the spirit and scope of the invention as defined by the appended claims. The various embodiments used to describe the principles of the present invention are by way of illustration only and should not be construed in any way to limit the scope of the invention. Those skilled in the art will understand that the principles of the present invention may be implemented in any suitably arranged device.

I claim:

1. An instructional golf device comprising:

a mat having a front and rear end and having an upper and a lower surface wherein a directional marker indicates a preferred, swing path of a golf club, said directional marker runs lengthwise along the upper surface, of said mat and a first series of apertures is centrally located along said directional marker at the front end and a second series of apertures is centrally located along said directional marker at the rear end;

a means for teeing a golf ball attached to said mat via one aperture of the first series of apertures;

a small spring attached to said mat via one aperture of the second series of apertures wherein said small spring protrudes vertically above mat and is positioned such that a golf club held by a golfer will strike said small spring on the golfer's backswing; and an extensible member attached to said mat via one aperture of the first series of apertures wherein said extensible member protrudes from said mat at a right angle; and said extensible member protruding towards the golfer; wherein said extensible member provides the golfer visual indicia of correct placement for the golfer's lead foot.

2. A golf contest comprising:

the instructional golf device of claim 1;

a short flight golf ball;

and a target.

* * * * *